US005207557A

United States Patent [19]

Smiley, III et al.

[11] Patent Number: 5,207,557

[45] Date of Patent: May 4, 1993

[54] CENTRIFUGAL FAN HAVING VARIABLE WIDTH BLADES

[75] Inventors: William A. Smiley, III, La Crosse; George T. Brockman, Stoddard, both of Wis.

[73] Assignee: American Standard Inc., New York, N.Y.

[21] Appl. No.: 880,726

[22] Filed: May 8, 1992

[51] Int. Cl.[5] ..... F04D 29/46; F01D 7/00

[52] U.S. Cl. ..... 415/157; 415/158; 416/184; 384/42

[58] Field of Search ..... 415/126, 131, 132, 157, 415/158; 416/184; 384/42, 49

[56] References Cited

U.S. PATENT DOCUMENTS

| | | | |
|---|---|---|---|
| 1,656,012 | 1/1928 | Nagler | 415/157 |
| 1,834,959 | 12/1931 | May | 415/157 |
| 2,143,100 | 1/1939 | Anderson | 415/157 |
| 2,459,815 | 1/1949 | Hammell | 415/157 |
| 3,019,963 | 2/1962 | Eck . | |
| 4,135,850 | 1/1979 | D'Anjou | 415/148 |
| 4,177,007 | 12/1979 | Schlangen et al. | 415/160 |
| 4,808,068 | 2/1989 | Asbjornson et al. | 415/157 |
| 4,828,455 | 5/1989 | Kinbara et al. | 415/157 |
| 4,929,150 | 5/1990 | Daw | 415/157 |

FOREIGN PATENT DOCUMENTS

| | | | |
|---|---|---|---|
| 29366 | 8/1884 | Fed. Rep. of Germany | 415/157 |
| 364732 | 12/1922 | Fed. Rep. of Germany . | |
| 593555 | 8/1925 | France | 415/157 |
| 101361 | 12/1961 | Netherlands | 415/157 |

*Primary Examiner*—Edward K. Look
*Assistant Examiner*—Michael S. Lee
*Attorney, Agent, or Firm*—William J. Beres; O'Driscoll; Peter D. Ferguson

[57] ABSTRACT

A centrifugal fan has blades the effective width of which are variable during fan operation through the actuation of modulation apparatus which rotates with the fan wheel and is driven thereby. The modulation apparatus isolates the blocked off and unused portions of the fan blades which prevents the interaction of the blocked off portion of the blades with air flowing through the fan housing in a manner which results in a highly efficient and extremely quiet fan.

14 Claims, 4 Drawing Sheets

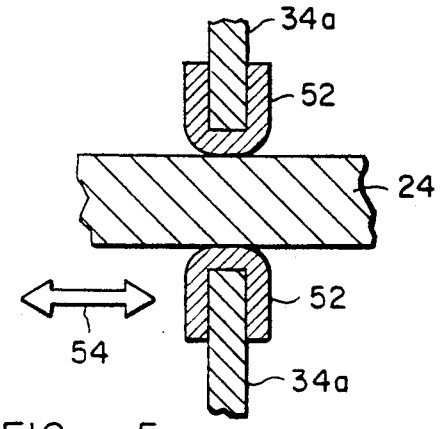
FIG. 5a
FIG 5b
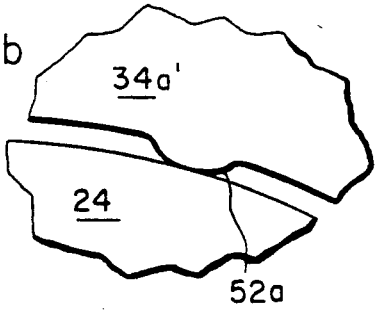
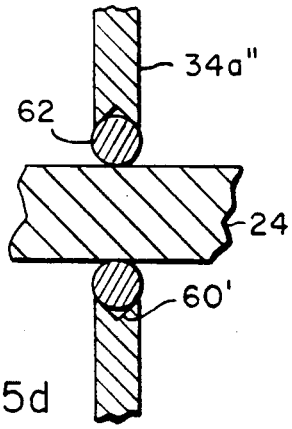
FIG. 5d
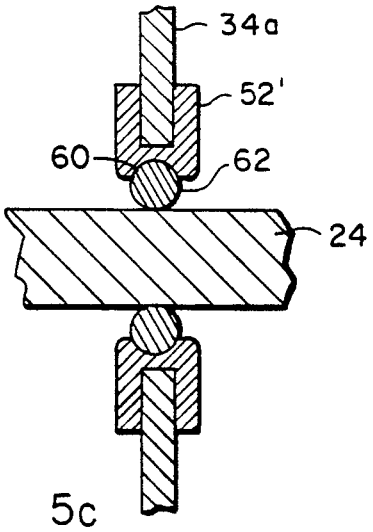
FIG. 5c

CENTRIFUGAL FAN HAVING VARIABLE WIDTH BLADES

BACKGROUND OF THE INVENTION

This invention relates to centrifugal fans and, more particularly, to a centrifugal fan having a mechanism for varying the effective width of the fan's blades while the fan is in operation.

Many modulation schemes exist by which the regulation of centrifugal fan operation can be accomplished so as to reduce fan power consumption when load conditions permit. Among such fan modulation schemes are systems predicated on the use of (1) discharge dampers, (2) inlet guide vanes, (3) eddy-current clutches, (4) variable speed belt drives, (5) AC frequency inverters, (6) variable pitch fan blades and (7) hubs, disposed radially interior of the blade set, which are moveable within a fan wheel.

All of the above in one way or another relate to the control of a centrifugal fan so as to minimize power consumption by the fan motor. Several deal with the varying of fan speed in accordance with load conditions while others allow for fan operation at constant speed but at reduced load.

The selection of a particular fan modulation scheme depends upon many factors. Among these factors are system size, fan and system operating conditions, load distribution, fan type (i.e., forward curved, backwardly inclined or air foil blades) as well as maintenance requirements, space available for fan installation and, often most importantly, noise and cost.

The overall goal of fan modulation is to deliver only the required volume of air based upon local demand conditions at the lowest energy and initial investment costs. The favored and most economical fan modulation scheme, when first cost is a primary consideration, involves the use of inlet guide vanes on air handlers equipped with forward curved blades. Inlet guide vane mechanisms, as best exemplified by U.S. Pat. No. 4,177,007 which is assigned to the assignee of the present invention, are relatively simple yet rugged and cost-efficient apparatus by which fan modulation can be accomplished.

Inlet guide vanes modulate fan load by imparting a spin to the air delivered to the fan wheel in the direction of fan wheel rotation. The effect of this spin or pre-swirl is to cause the unloading of the fan blades which decreases the volume of the air delivered by the fan which, in turn, decreases the horsepower required to drive the fan wheel. While currently the fan modulation method of choice, along with dramatically more expensive variable speed inverter drives, inlet guide vanes do have drawbacks which detract from their efficiency and attractiveness for use.

A primary disadvantage in the use of inlet guide vanes relates to their disposition near or in the inlet of a centrifugal fan where they act as an impediment to airflow at peak load conditions. Conversely, at low load conditions many inlet guide vane mechanisms are "leaky" and allow for the passage of a significant amount of unneeded air into the fan housing. This additional air only adds to the load on the fan and does not serve any purpose with respect to building climate control.

Further, inlet guide vanes can, under some circumstances, be relatively noisy both with respect to their mechanical operation and in their interaction with air flowing through the fan inlet. Noise can be an extremely critical factor in many fan installations, particularly to the extent the noise might be communicated into a work or office space adjacent to or near the fan.

One approach to fan modulation, if successfully implemented with a sufficient degree of reliability and efficiency as has not yet heretofore been the case, relates to varying the effective width of the blades of a centrifugal fan wheel while the fan is in operation. By varying effective blade width, essentially all of the advantages of inlet guide vanes result while many of the disadvantages are negated. The superior power unloading characteristics of variable blade width fans is significant as, potentially, is their quietness, all at a cost competitive with inlet guide vanes and dramatically less than variable speed drives.

The primary reason for the lack of a commercially viable, highly efficient centrifugal fan blade width varying arrangement relates to the high operating speeds and centrifugal forces which exist with respect to fan operation and the need to have the modulation apparatus rotate with the fan wheel to achieve both the efficiency and quietness goals. Only one arrangement relating to variable width fan blades is known where the apparatus by which the effective blade width is changed rotates with the fan wheel. That arrangement, illustrated in U.S. Pat. No. 3,019,963, relates to a blower for use with gases having high dust content.

The modulation apparatus of the latter device includes a very substantial moveable disc of box like construction the displacement of which changes the admission of the "intensive gas-dust mixture". The use of the disc is a feature which can be provided "in addition to" a "guiding device" where the guiding device consists of airflow guiding vanes disposed in the inlet of the fan. Such construction is not appropriate to a centrifugal fan used in air delivery systems for building ventilation purposes where fan noise is an extremely critical factor. Further, because the "unused" portion of the fan blades remain exposed to air within the fan housing, the unused portion of the blades and the air within the housing do interact to the detriment of fan efficiency and quietness.

Other arrangements by which the effective width of centrifugal fan blades have been modulated include the use of shroud mechanisms, as is illustrated in Patentschrift 364732 and U.S. Pat. No. 4,135,850. Still other related mechanisms employ moveable members disposed interior of the fan wheel which, when actuated, block off a portion of the fan wheel from airflow through the fan inlet. Exemplary in this regard are U.S. Pat. Nos. 4,808,068 and 4,929,150. Virtually all such arrangements, because they do not rotate with the fan wheel, leave the "blocked off" portions of the fan blades exposed to air flowing within the housing which adversely affects fan efficiency and noise characteristics.

The need therefore continues to exist for a centrifugal fan modulation arrangement, operable while the fan is in operation, by which the effective width of the blades of the fan is varied in accordance with airflow demand and which achieves efficiencies and quietness levels not heretofore attained through the isolation of the unused portions of the fan blades and the prevention of their interaction with air flowing through the fan housing.

SUMMARY OF THE INVENTION

It is a primary object of the present invention to provide apparatus by which the effective width of the blades of centrifugal fan is varied, while the fan is in operation, so that the fan produces only that amount of airflow required of it thereby minimizing energy consumption by the fan motor.

It is another primary object of the present invention to provide modulation apparatus by which the effective width of the blades of a centrifugal fan is varied, while the fan is in operation, where the unused portions of the fan blades are prevented from interacting with air flowing through the fan housing in a manner which significantly enhances fan noise characteristics and efficiency.

It is a still further object of the present invention to provide mechanical apparatus for varying the effective width of the blades in a centrifugal fan where the apparatus rotates with the fan wheel and is carried and driven thereby.

Finally, it is an object of the present invention to provide fan modulation apparatus which achieves efficiencies and sound levels superior to those of inlet guide vanes at costs dramatically less than those of inverter drives.

These and other objects of the present invention, which will become apparent when the Drawing Figures and following Description of the Preferred Embodiment are considered, are accomplished by a centrifugal fan in which the effective width of the blades is varied, while the fan is in operation, by the movement of modulating apparatus that rotates with the fan wheel which (1) blocks off a portion of the fan blades so as to increase fan efficiency by producing only the airflow being demanded of the fan and (2) prevents the blocked off portions of the blades from interacting with air flowing through the fan housing to reduce generated noise.

By adjustably blocking off portions of the fan blades so that only a predetermined portion of each blade is used to move air, while preventing the remaining portion of each blade from interacting with air flowing through the fan housing, efficient means for modulating airflow through the fan housing, in accordance with airflow demand, is achieved in a manner which minimizes the fan noise which would otherwise result from the interaction of the air flowing through the fan with the unused portions of the fan blades.

BRIEF DESCRIPTION OF THE DRAWING FIGURES

FIGS. 5*a*, 5*b*, 5*c* and 5*d* are detailed views of a preferred and alternative support arrangements of the modulation apparatus of the present invention on the fan wheel.

Figure 6:
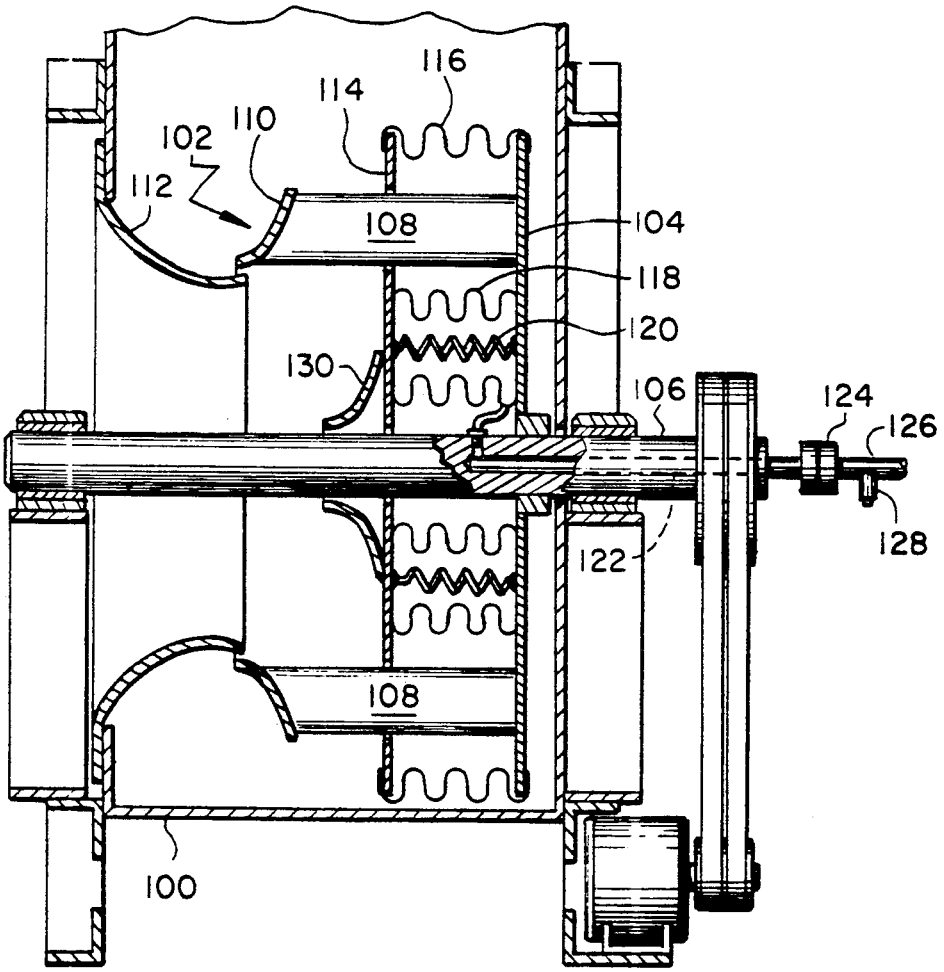

FIGS. 6 illustrates an alternative embodiment of the present invention in a single width fan wheel application.

DESCRIPTION OF THE PREFERRED EMBODIMENT

Figure 1:
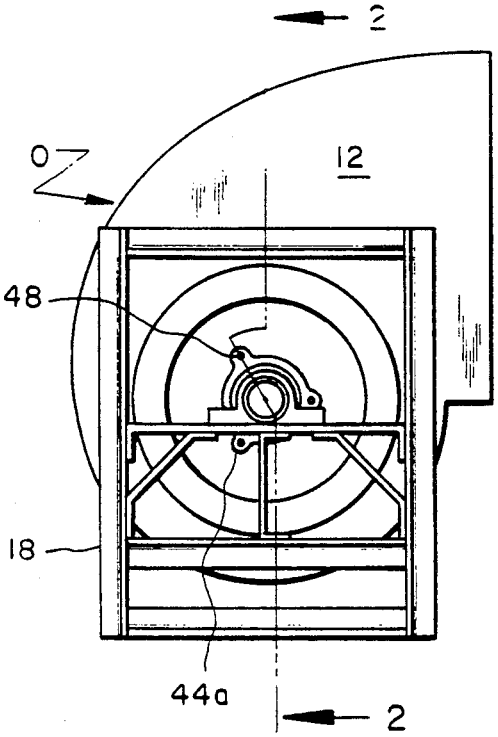
FIG. 1 is a side view of a double width centrifugal fan which employs the apparatus of the present invention.
Figure 2:
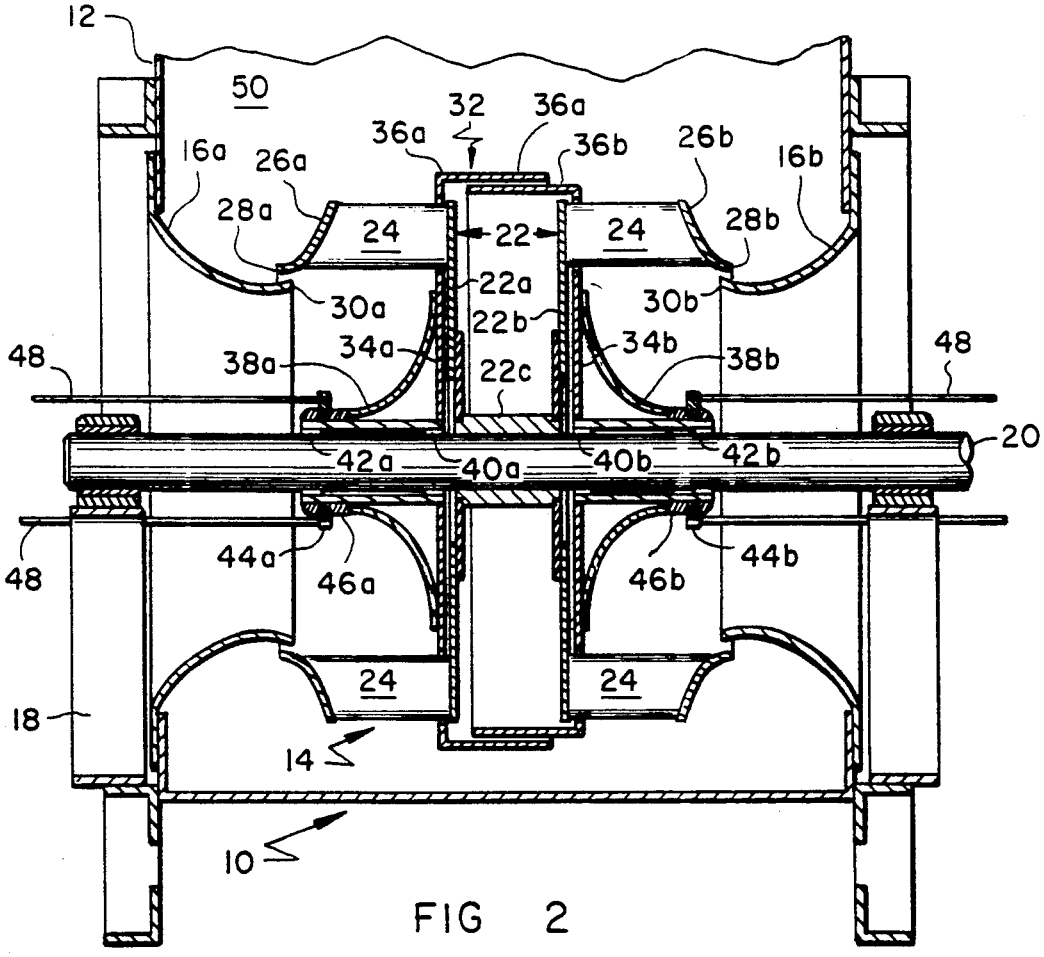
FIG. 2 is a view taken along line 2—2 of FIG. 1 illustrating the apparatus of the present invention with the airflow modulation apparatus of the present invention in its fully retracted state such that airflow through the fan is at full capacity.
Figure 3:
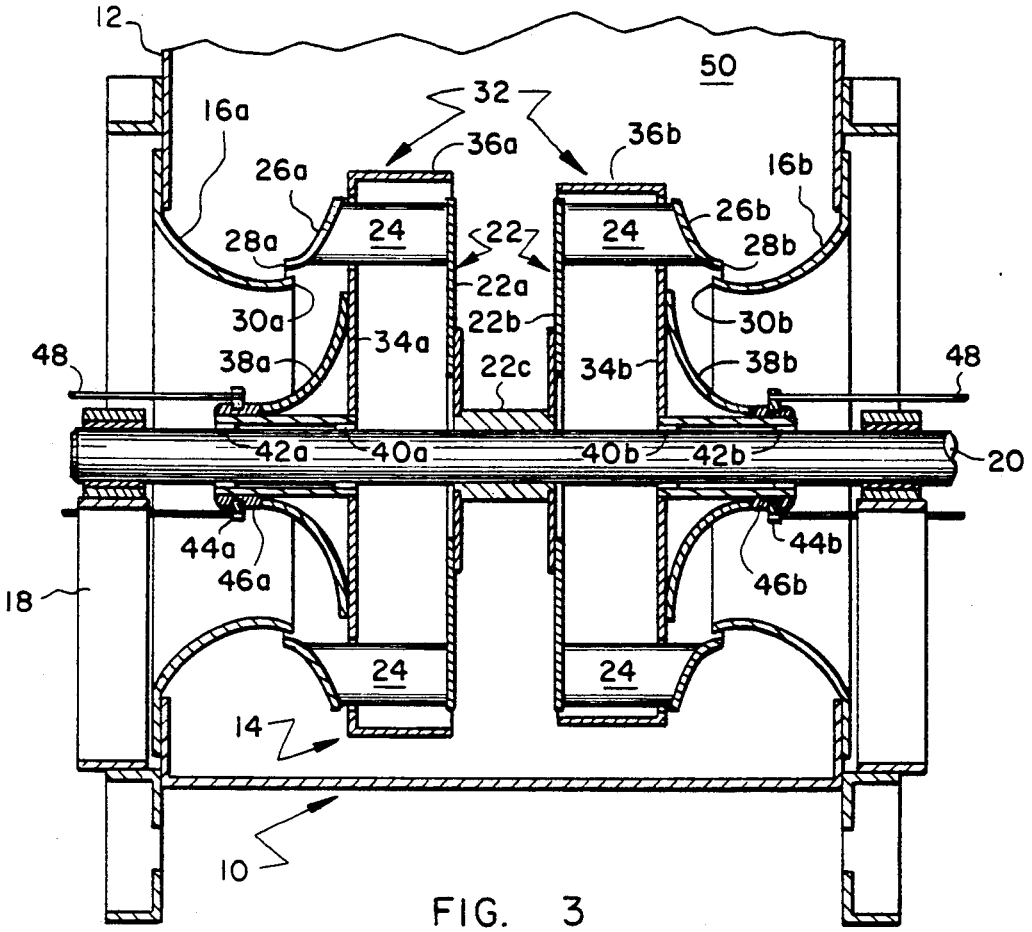
FIG. 3 is likewise a view taken along line 2—2 of FIG. 1 showing the airflow modulation apparatus of the present invention in its fully extended state such that airflow through the fan housing is reduced to a minimum by the reduction of effective fan blade area to the maximum extent possible.

Referring concurrently to FIGS. 1, 2 and 3, centrifugal fan 10 has a housing 12 in which a double width fan wheel 14 is disposed for rotation. Housing 12 includes orifice defining curvilinear inlet members 16*a* and 16*b* which extend axially into fan housing 12 which is mounted on a framework 18. Fan wheel 14 is fixedly mounted on a drive shaft 20 which is driven by a motor, not shown in FIGS. 1, 2 or 3.

Fan wheel 14 has a back plate 22 which is fixedly mounted on drive shaft 20 so as to be driven thereby. In the embodiment of FIGS. 1, 2 and 3, back plate 22 has first and second sidewalls 22*a* and 22*b* which extend radially outward from a common hub 22*c*. A plurality of fan blades 24 extend from each of sidewalls 22*a* and 22*b*, toward the respective fan inlet members 16*a* and 16*b*, in respective first and second fan blade sets.

The ends of blades 24 opposite the ends attached to back plate 22 are attached to circumferential ring members 26*a* and 26*b*. The radially innermost portions 28*a* and 28*b* of ring members 26*a* and 26*b* are juxtaposed the axially inner most portions 30*a* and 30*b* of inlet members 16*a* and 16*b* to provide for a smooth curvilinear transition and continuous change in airflow direction as air flows from the inlet members into the fan wheel.

Airflow modulating apparatus 32 is mounted within fan housing 12 and includes baffle members 34*a* and 34*b*. Baffle members 34*a* and 34*b* rotate with the fan wheel and are penetrated by fan blades 24 so as to be driven thereby. Baffle members 34*a* and 34*b* include circumferential block off members 36*a* and 36*b* which extend from the baffle members 34*a* and 34*b* in a direction away from inlet members 16*a* and 16*b* and, in the embodiment of FIG. 1, axially inward of the fan housing past the respective back plate sidewalls 22*a* and 22*b*.

Modulation apparatus 32 may optionally include a transition portions 38*a* and 38*b* which have contoured curvilinear faces that assist in smoothing the change in airflow direction within the fan housing. As will be appreciated, baffle members 34*a* and 34*b*, block off members 36*a* and 36*b* and, if provided, transition portions 38*a* and 38*b* of modulation apparatus 32 all rotate with and are driven by fan wheel 14.

It will be noted that in the embodiment of FIG. 1 the diameter of baffle member 34*b* is slightly less than that of baffle member 34*a* so that in the retracted position illustrated, block off member 36*b* is nested within block off member 36*a*. This reduces the width of the fan housing needed to accommodate this embodiment of the modulation apparatus.

Modulation apparatus 32, while driven by and rotating with fan wheel 14 is mounted for axial movement with respect to drive shaft 20. In the embodiment of FIG. 1 modulation apparatus 32 is illustrated as having axially inner and outer slide bearings 40*a* and 40*b* and 42*a* and 42*b* respectively which are slideable on drive shaft 20 even while drive shaft 20 is rotating.

It is to be appreciated that slide bearings 40*a* and 40*b* and 42*a* and 42*b* rotate with the modulation apparatus and at the same speed as drive shaft 20. There is thus no relative motion as between the slide bearings and drive shaft 20, even while fan wheel 14 is rotating unless modulation apparatus 32 is actuated to move axially with respect to the drive shaft. Therefore, the axial movement of slide bearings 40*a* and 40*b* and 42*a* and 42*b* on drive shaft 20 involves only the slideable movement of the bearing surfaces over a surface which is not otherwise moving with respect to them.

The precise nature of the moveable contact as between modulation apparatus 32 and drive shaft 20 is not critical and it is within the scope of the present invention that bearings 40*a* and 40*b* and 42*a* and 42*b* be eliminated in favor of an arrangement by which apparatus 32 is carried and supported by the fan blades and is moved axially of drive shaft 20 without being in contact therewith.

Still referring to the embodiment of FIGS. 1, 2 and 3, disposed at the end of transition portions 38*a* and 38*b* of modulation apparatus 32 are roller bearings 44*a* and 44*b*. The inner races of bearings 44*a* and 44*b* are fixed with respect to and rotate with the modulation apparatus 32. Bearings 44*a* and 44*b* are respectively disposed in collar members 46*a* and 46*b* which are formed at the axially outermost ends of the transition portions 38*a* and 38*b* of the modulation apparatus.

The outer races of bearings 44*a* and 44*b* are stationary with respect to the rotating inner races and are connected to and are acted upon by the movement of actuator rods 48. The movement of rods 48 axially of drive shaft 20 causes the displacement of modulation apparatus 32 within the fan housing even while the fan and modulation apparatus are rotating.

The apparatus by which rods 48 are actuated to move axially of drive shaft 20 are not shown as a variety of apparatus, including electrical, pneumatic and mechanical actuation apparatus is envisioned by which such movement can be accomplished. Alternatively, the actuation apparatus discussed immediately above may be dispensed with in favor of actuation apparatus which is disposed interior of the fan wheel as will be discussed below with respect to an alternative embodiment.

Referring primarily now to Drawing FIGS. 2 and 3, it will be appreciated that modulation apparatus 32 is positionable between a fully retracted position, as illustrated in FIG. 2 and a fully extended position as illustrated in FIG. 3. It will additionally be appreciated that modulation apparatus 32 may be positioned anywhere between the fully retracted and fully extended positions so as to result in the availability of continuous fan unloading capability over a very large portion of the fan's capacity.

In the fully retracted position of FIG. 2, it will be appreciated that fan blades 24 have their full effect on air entering the fan housing since essentially no portion of the blades are blocked off from air flowing into fan housing 12 through fan inlet members 16*a* and 16*b*. The full surface area of each of fan blade 24 will therefore be employed to move air through fan 10 with the result that fan 10 will move the maximum amount of air it is capable of moving at the speed at which it is rotating.

It will be appreciated that if modulation apparatus 32 is caused to be moved to the position illustrated in FIG. 3, the portion of the fan blades 24 between baffle members 34*a* and 34*b* of the modulation apparatus and back plate sidewalls 22*a* and 22*b* of the fan wheel will be blocked off and isolated from air flowing into fan housing 12 through fan inlet members 16*a* and 16*b*. The blocked off portion of the fan blades will be prevented from interacting with the air flowing through fan 10, both before the air has entered fan wheel 14 and after the air has exited the fan wheel and entered the interior 50 of housing 12.

The deactivated portions of fan blades will therefore have essentially no direct interaction with the air flowing through the fan housing thereby preventing the creation of the noise which would otherwise be generated by the interaction with the unused portion of the fan blades with the air flowing through the fan. Simultaneously, a significant increase in fan efficiency through the use of only those portions of the fan blades which are required to meet the airflow demand is achieved. Airflow through the fan housing is therefore capable of being modulated over an extremely wide volumetric range in a manner which is not detracted from, with respect to fan energy consumption and noise production, by the interaction of the inactive portions of the fan blades with the air flowing through the interior of the fan housing.

Figure 4:
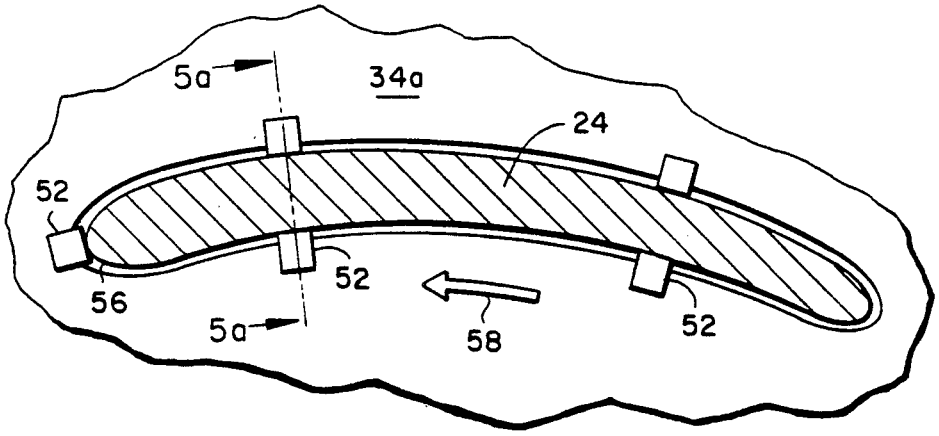
FIG. 4 is a view illustrating the penetration and support of the airflow modulation apparatus of the present invention by the blades of the fan wheel of FIGS. 2 and 3.

Referring now to FIGS. 4 and 5a, the manner in which modulation apparatus 32 is carried and driven by fan wheel 14 is illustrated. Baffle member 34*a* defines a plurality of conforming and accommodating blade-shaped slots which are closely dimensioned to the contour of the blades 24 which pass through them. Baffle member 34b, not shown, will have similar slots. The nature of the fan blades themselves is not critical to the invention although its use with forward curved (FC) or backwardly inclined (BI) blades is suggested.

A plurality of support members 52 are interposed between baffle member 34a and at least some of blades 24 to provide for the slideable engagement of the support members with the exterior surface of the fan blades 24. Support elements 52 are preferably fabricated from a material such as Teflon® so as to facilitate the free sliding contact of elements 52 with blade 24 and their movement, across the blade surfaces in the direction illustrated by arrow 54 in FIG. 5*a*, in a manner which minimizes friction and/or binding therebetween.

As is likewise illustrated, one support member will preferably be disposed so as to be in contact with the leading edge 56 of at least one blade 24 so that the rotational movement of the blade in the direction illustrated by arrow 58 in FIG. 4 is efficiently transmitted through the leading edge 56 of the fan blade to baffle member 34*a*.

It is to be noted that support members 52 could theoretically be dispensed with in favor of integral protrusions 52*a* as illustrated in FIG. 5*b* which extend from a baffle member, such baffle member 34*a*', into contact with blade 24. This arrangement might prove particularly advantageous in instances where baffle member 34*a*' is fabricated from a relatively lightweight but rigid plastic-like material. Members 52 might also be dispensed with where transition portions 38*a* and 38*b*, if they have slide bearings 40*a* and 40*b* and 42*a* and 42*b*, are employed to support the modulation apparatus. In such cases leading edge fan blade contact with the baffle member would cause the rotation of the modulation apparatus.

Referring now to FIG. 5*c* another embodiment of the support arrangement is illustrated. In this embodiment, support member 52', disposed on baffle member 34*a*, defines a hemispherical surface 60 which faces a surface of fan blade 24. A ball 62 is conformingly disposed between surface 60 and blade 24 so as to be in rolling contact with the surface of each.

Ball 62, like support member 52' may be fabricated from a Teflon-like material or from a metal. The rolling contact between ball 62 and both of support member 52' and blade 24 facilitates the axial movement of baffle member 34 with respect to blade 24. As is illustrated in FIG. 5*d*, it will be appreciated that support members 52" of FIG. 5*c* could be dispensed with and baffle member 34*a'* itself could define the surface 60' in which ball 62 would ride.

Referring now to FIG. 6, an alternative embodiment of the present invention, as it might relate to a centrifugal fan having a single width fan wheel, is illustrated. Fan housing 100 has a single width centrifugal fan wheel 102 disposed therein. Fan wheel 102 has a backplate 104 which is attached to and driven by a drive shaft 106. A plurality of fan blades 108 extend from backplate 104 and are connected by a ring member 110. The radially inner edge of ring member 110 is disposed closely adjacent the axially innermost edge of inlet orifice 112 which is fixedly attached to or, alternatively, an integral part of fan housing 100.

In the embodiment of FIG. 6, the airflow modulation apparatus includes an axially moveable baffle member 114 which rotates with and is carried and driven by fan blades 108 in the manner illustrated in FIG. 5*a*, one its alternatives or an equivalent. Baffle member 114 is, in essence and function, similar to baffle members 34*a* and 34*b* of the embodiment of FIGS. 1, 2 and 3. In the embodiment of FIG. 6, however, the transition portions 38*a* and 38*b* of FIGS. 1–3 are dispensed with and the block off portion of the modulation apparatus is modified.

Still referring to FIG. 6, it will be appreciated that baffle member 114 is connected to backplate 104 by a flexible circumferential shroud 116 which blocks off any unused and unneeded portion of blades 108 from the air flowing through housing 100 in a manner similar to block off members 36*a* and 36*b* of the preferred embodiment. The use of transition portion 130, which is similar in structure and effect to the transition portions 38*a* and 38*b* of the preferred embodiment, is optional. Baffle member 114 is axially positioned on blades 108 by apparatus which includes a circumferentially disposed, donut-shaped, pneumatically actuated bellows member 118 and tension springs 120.

Tension springs 120 are such that their natural proclivity is to cause baffle 114 to retract toward backplate 104 of the fan wheel in a manner which exposes essentially the entire surface area of each of blades 108 to air flowing through the fan housing. Springs 120 are circumferentially located to act evenly on baffle member 114 so as not to cause the baffle member to tip, tilt or bind with respect to the surface of the fan blades.

When a pressurized fluid, such as air, is introduced within bellows member 118, the bellows member is caused to expand against backplate 104, which is fixed on drive shaft 106, thereby urging baffle member 114 away from the backplate. It will be appreciated that under such circumstances springs 118, which need not be disposed within the bellows, are caused to extend and that the pressure within the bellows member acts against the springs 120 which are in tension.

As baffle member 114 is caused to move away from backplate 104, shroud 116 is caused to extend over the unused portions of each of the fan blades 108 to render them ineffective and to isolate them from airflow. In its fully extended position, bellows 118 will cause baffle member 114 to be positioned in a manner such that shroud 116 covers a large majority of the surface of each fan blade.

This arrangement, like the preferred embodiment earlier described, is therefore capable of modulating the flow of air through the fan housing over a continuous and large range while isolating the unused portion of the fan blades so as to prevent their interaction with and effect on the air flowing through the fan housing. Energy efficiency is therefore enhanced while the production of noise due to the interaction of the unused portion of the fan blades with the air flowing through the housing is prevented.

It will be appreciated that bellows 118 can be actuated in many ways such as by the definition of a conduit 122 passing through hollow drive shaft 106 to bellows 118. In the embodiment of FIG. 6, conduit 122 is attached to a coupling 124 which both accommodates the rotation of conduit 122 and the hookup of a non-rotating pressure source 126 to it. Baffle member 114 can be caused to retract, at the urging of tension springs 120 when the pressurized fluid, such as air, within bellows 118 is vented there out of such as through a controllable vent valve 128 which is schematically illustrated.

It will be appreciated that baffle member 114, like baffle members 34*a* and 34*b* in the embodiment of FIGS. 1, 2 and 3, is positionable in any axial position between backplate 104 and ring member 110 in a manner which varies the effective width of the blades 108 of the fan wheel while preventing the interaction of the unused and ineffective portions of the fan blades with the air flowing through the fan housing. The development of noise within the fan from the interaction of the unused portion of the fan blades with the air flowing therethrough is thus prevented while overall fan efficiency is enhanced.

It will be appreciated that there are other ways, within the scope of this invention, by which the actuation and positioning of the modulation apparatus can be accomplished and that the present invention broadly contemplates rotating apparatus which varies the effective width of the fan blades of the fan wheel in a manner which isolates the unused portion of the fan blades from interaction with the air which is carried through and moved by the fan wheel. Therefore, the scope of the present invention should not be limited other than in accordance with the language of the claims which follow.

What is claimed is:

1. A fan comprising:

a housing defining an inlet;

a fan wheel disposed for rotation in said housing, said fan wheel having a plurality of fan blades and a back plate;

means, including a baffle member penetrated by and movable with respect to said fan blades, for modulating airflow through said housing, said baffle member rotating with said fan wheel and cooperating therewith to define effective and ineffective portions of said fan blades, said means for modulating airflow having a block off portion extending from said baffle member in a direction toward said back plate, said block off portion being a circumferential shroudlike member which is unattached to said back plate, said baffle member, said back plate and said shroud like member cooperating to isolate said ineffective portions of said fan blades from air flowing through said housing;

means for supporting said modulating means for rotation with said fan wheel and for movement relative to said fan blades while said fan wheel is rotating; and means for causing the movement of said modulating means with respect to said fan blades while said fan wheel is rotating.

2. The fan according to claim 1 wherein said fan blades are connected to and extend from said back plate and wherein said fan wheel further comprises ring means connected to said fan blades for providing, in cooperation with said housing inlet, a smooth and continuous change in airflow direction as air flows into said fan wheel.

3. The fan according to claim 2 wherein said supporting means comprises means, disposed between said baffle member and at least one of said fan blades, in slideable contact with said at least one of said fan blades.

4. The fan according to claim 3 further comprising a transition portion attached to said baffle member, said transition portion interacting with air flowing into said housing to facilitate a change in direction of said air.

5. The fan according to claim 4 wherein said back plate is fixedly mounted on a drive shaft and wherein said means for supporting said baffle member further comprises bearing means mounted on said transition portion in slideable contact with said drive shaft.

6. A fan comprising:

a housing;

a fan wheel disposed for rotation in said housing, said fan wheel having a plurality of fan blades and a back plate;

means, including a baffle member axially movable of said fan blades and penetrated thereby for modulating airflow through said housing, said modulating means rotating with said fan wheel and cooperating therewith to define effective and ineffective portions of said fan blades, said modulating means including an expansible member attached to both said baffle member and said back plate, said ineffective portions of said fan blades being isolated from air flowing through said housing by said baffle member, said expansible member and said back plate; and means for causing the movement of said modulating means with respect to said fan blades while said fan wheel is rotating.

7. A fan comprising:

a housing having a first and a second inlet;

a fan wheel said fan wheel being a double width fan wheel having a first and a second set of fan blades;

means, movable with respect to said first and said second set of fan blades, for modulating airflow through said housing, said means for modulating airflow including a first and a second baffle member, said first baffle member being penetrated by said first blade set and said second baffle member being penetrated by said second blade set, said first and said second baffle members each having a block off portion, the block off portion of said first baffle member being nestable within the block off portion of said second baffle member, said modulating means rotating with said fan wheel and cooperating therewith to define effective and ineffective portions of said fan blades, said ineffective portions being isolated from air flowing through said housing; and means for causing movement of said modulating means, said means for causing movement being operable to move said first and said second baffle members in opposite directions while said fan wheel is rotating.

8. What is claimed is a centrifugal fan comprising:

a fan housing, said housing defining a first and a second inlet;

a centrifugal fan wheel, said fan wheel being a double width fan wheel having a back plate fixedly mounted on a drive shaft and a first and a second set of fan blades extending from said back plate toward said first and said second fan inlets;

means, axially moveable with respect to said drive shaft and rotatable with said fan wheel, for variably defining effective and ineffective portions of said first and said second set of said fan blades, said means for variably defining portions of said fan blades including a first and a second baffle member penetrated respectively by said first and said second set of fan blades, said first and said second baffle members each having a block off portion, the block off portion of said first baffle member being nested within the block off portion of said second baffle member when said means for variably defining effective and ineffective portions of said first and said second set of fan blades are positioned within said housing to define maximum effective portions of each of said blade sets, said first and said second baffle members, their respective block off portions and said back plate cooperating to isolate said ineffective portions of said first and said second sets of fan blades from air flowing through said fan housing; and means for causing the concurrent movement of said first and said second baffle members axially of said drive shaft in opposite directions while said fan wheel is rotating.

9. The centrifugal fan according to claim 8 wherein each of said block off portions is a rigid shroudlike member.

10. The centrifugal fan according to claim 9 wherein said fan wheel has a first and or second ring attached to said first and second sets of fan blades respectively said first and said second rings cooperating with said first and said second housing inlets to provide a smooth and continuous change in airflow direction as air enters said fan wheel.

11. The centrifugal fan according to claim 9 wherein said block off portions of said first and said second baffle members are each expansible members attached to both one of said baffle members and said back plate.

12. The centrifugal fan according to claim 9 further comprising means, in sliding contact with at least one of said fan blades, for supporting said first and said second baffle members, said supporting means being disposed between said baffle members and said at least one of said fan blades.

13. The centrifugal fan according to claim 12 further comprising a transition portion attached to each of said first and said second baffle members, each of said transition portions interacting with air flowing through said fan housing to change the direction thereof.

14. The centrifugal fan according to claim 16 further comprising bearing means disposed between said drive shaft and each of said transition portions.

* * * * *